US009532914B1

(12) United States Patent
Nichols

(10) Patent No.: US 9,532,914 B1
(45) Date of Patent: Jan. 3, 2017

(54) LIFTING ASSISTANCE DEVICE

(71) Applicant: Rizalina Nichols, Birmingham, AL (US)

(72) Inventor: Rizalina Nichols, Birmingham, AL (US)

( * ) Notice: Subject to any disclaimer, the term of this patent is extended or adjusted under 35 U.S.C. 154(b) by 0 days.

(21) Appl. No.: 14/871,565

(22) Filed: Sep. 30, 2015

(51) Int. Cl.
*A61G 7/10* (2006.01)

(52) U.S. Cl.
CPC ..... *A61G 7/1023* (2013.01)

(58) Field of Classification Search
CPC ..... A61G 7/10
USPC ..... 5/81.1 T, 89.1, 81.1 R
See application file for complete search history.

(56) References Cited

U.S. PATENT DOCUMENTS 4,944,057 A 7/1990 Shaw
4,994,057 A * 2/1991 Carmen ..... A61J 1/2089 206/221
D366,550 S 1/1996 Shapiro
5,963,995 A 10/1999 Glass
6,073,280 A * 6/2000 Farnum ..... A61F 5/03 128/876
D437,263 S 2/2001 Dahlberg et al.
6,196,229 B1 3/2001 Piazza
6,230,329 B1 5/2001 Jennings
7,627,912 B1 * 12/2009 McKinney ..... A61G 7/1011 5/81.1 R
D629,583 S * 12/2010 Liljedahl ..... D34/35
8,226,588 B2 * 7/2012 Horvath ..... A61F 5/028 119/856
2003/0233705 A1 12/2003 Oja
2005/0204470 A1 * 9/2005 Main ..... A61G 7/1023 5/81.1 T
2009/0144894 A1 6/2009 Shiffert

* cited by examiner

*Primary Examiner* — Fredrick Conley

(57) ABSTRACT

A lifting assistance device to aid in lifting an immobile person includes a panel that is flexible and has opposing ends that comprise sleeves. A first fastener is coupled to a first end of a strap. A second fastener is adjustably coupled to the strap between the first end and a second end of the strap. The second fastener is complimentary to the first fastener. The strap is positioned in and extends through the sleeves, such that the first fastener and the second fastener extend from the sleeves on a respective one of a pair of opposing edges of the panel. The first fastener is couplable to the second fastener to form a loop. The loop has a pair of exposed sections positioned adjacent to the opposing edges of the panel.

6 Claims, 3 Drawing Sheets

LIFTING ASSISTANCE DEVICE

BACKGROUND OF THE DISCLOSURE

Field of the Disclosure

The disclosure relates to assistance devices and more particularly pertains to a new assistance device to aid in lifting an immobile person.

SUMMARY OF THE DISCLOSURE

An embodiment of the disclosure meets the needs presented above by generally comprising a panel that is flexible and has opposing ends that comprise sleeves. A first fastener is coupled to a first end of a strap. A second fastener is adjustably coupled to the strap between the first end and a second end of the strap. The second fastener is complimentary to the first fastener. The strap is positioned in and extends through the sleeves, such that the first fastener and the second fastener extend from the sleeves on a respective one of a pair of opposing edges of the panel. The first fastener is couplable to the second fastener to form a loop. The loop has a pair of exposed sections positioned adjacent to the opposing edges of the panel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
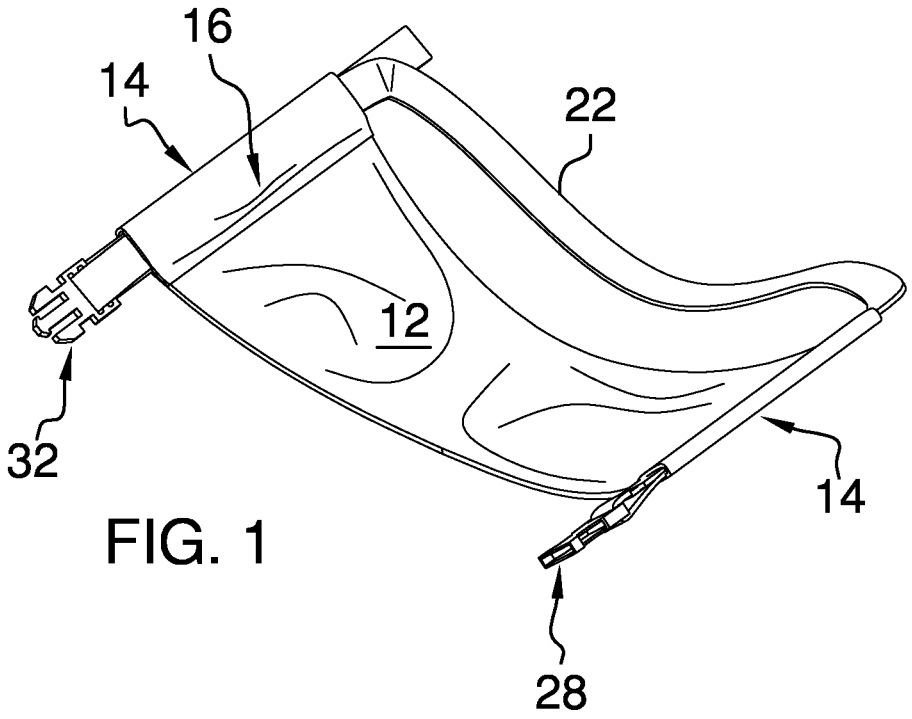
FIG. 1 is an isometric perspective view of a lifting assistance device according to an embodiment of the disclosure.
Figure 2:
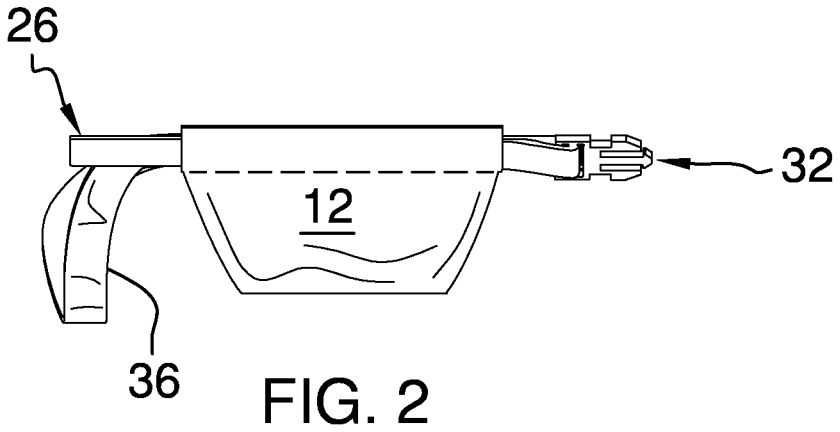
FIG. 2 is a front view of an embodiment of the disclosure.
Figure 3:
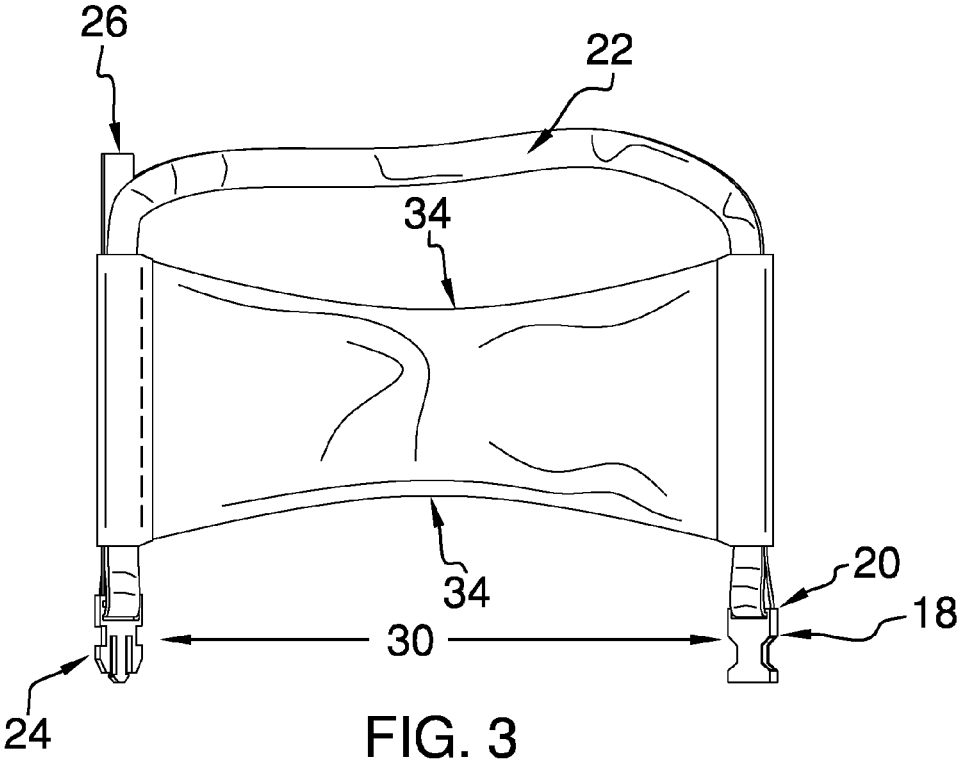
FIG. 3 is a top view of an embodiment of the disclosure.
Figure 4:
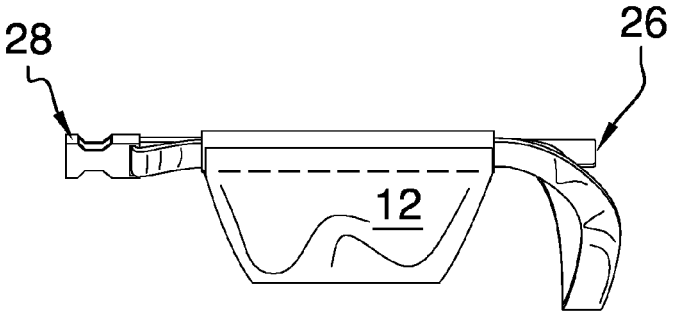
FIG. 4 is a back view of an embodiment of the disclosure.
Figure 5:
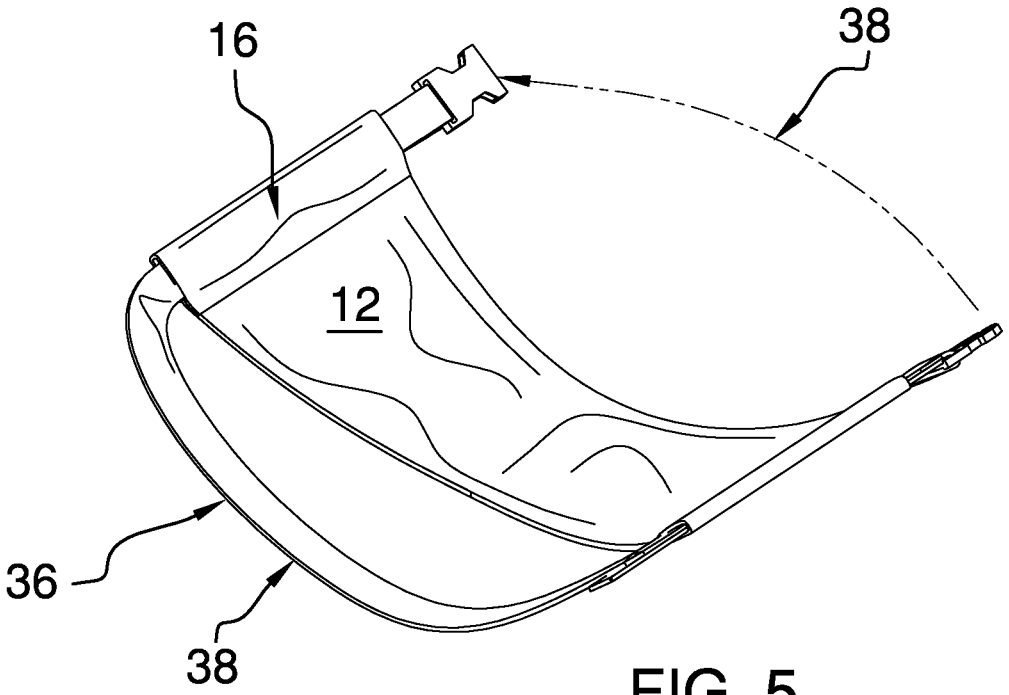
FIG. 5 is an isometric perspective view of an embodiment of the disclosure.

With reference now to the drawings, and in particular to FIGS. 1 through 5 thereof, a new assistance device embodying the principles and concepts of an embodiment of the disclosure and generally designated by the reference numeral 10 will be described.

As best illustrated in FIGS. 1 through 5, the lifting assistance device 10 generally comprises a panel 12 that is flexible and has opposing ends 14 that comprise sleeves 16. The panel 12 comprises nylon, preferably heavy duty nylon. The panel 12 is rectangular. A first fastener 18 is coupled to a first end 20 of a strap 22. A second fastener 24 is adjustably coupled to the strap 22 between the first end 20 and a second end 26 of the strap 22. The second fastener 24 is complimentary to the first fastener 18. The first fastener 18 comprises a female piece 28 of a side release buckle 30, while the second fastener 24 comprises a male piece 32 of the side release buckle 30. The strap 22 is positioned in and extends through the sleeves 16, such that the first fastener 18 and the second fastener 24 extend from the sleeves 16 on a respective one of a pair of opposing edges 34 of the panel. The strap 22 comprises nylon, preferably heavy duty nylon. The first fastener 18 is couplable to the second fastener 24 to form a loop 36. The loop 36 has a pair of exposed sections 38 positioned adjacent to the opposing edges 34 of the panel 12.

In use, the panel 12 is positioned between the legs of an immobile person with the opposing ends 14 positioned on the lower back and abdomen, such that the first fastener 18 can be coupled to the second fastener 24, creating the loop 36 with said pair of exposed sections 38 that the user may grasp to assist in lifting the immobile person.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A lifting assistance device comprising:

a panel, said panel being flexible, said panel having opposing ends comprising sleeves;

a first fastener, said first fastener being coupled to a first end of a strap;

a second fastener, said second fastener being adjustably coupled to said strap between said first end and a second end of said strap, said second fastener being complimentary to said first fastener;

said strap being positioned in and extending through said sleeves, such that said first fastener and said second fastener extend from said sleeves on a respective one of a pair of opposing edges of said panel; and said first fastener being couplable to said second fastener to form a loop, said loop having a pair of exposed sections positioned adjacent to said opposing edges of said panel.

2. The device of claim 1, further including said panel and said strap comprising nylon.

3. The device of claim 2, further including said panel and said strap comprising heavy duty nylon.

4. The device of claim 1, further including said panel being rectangular.

5. The device of claim 1, further comprising:

said first fastener comprising a female piece of a side release buckle; and said second fastener comprising a male piece of said side release buckle.

6. A lifting assistance device comprising:

a panel, said panel being flexible, said panel having opposing ends comprising sleeves, said panel comprising nylon, said panel comprising heavy duty nylon, said panel being rectangular;

a first fastener, said first fastener being coupled to a first end of a strap;

a second fastener, said second fastener being adjustably coupled to said strap between said first end and a second end of said strap, said second fastener being complimentary to said first fastener;

said first fastener comprising a female piece of a side release buckle, said second fastener comprising a male piece of said side release buckle;

said strap being positioned in and extending through said sleeves, such that said first fastener and said second fastener extend from said sleeves on a respective one of a pair of opposing edges of said panel, said strap comprising nylon, said strap comprising heavy duty nylon;

said first fastener being couplable to said second fastener to form a loop, said loop having a pair of exposed sections positioned adjacent to said opposing edges of said panel; and wherein said panel is positionable between the legs of an immobile person with said opposing ends positioned on the lower back and abdomen, such that said first fastener is couplable to said second fastener, defining said loop with said pair of exposed sections that the user may grasp to assist in lifting the immobile person.

* * * * *